US011911815B2

(12) United States Patent
Quintal et al.

(10) Patent No.: US 11,911,815 B2
(45) Date of Patent: Feb. 27, 2024

(54) ROBOTIC SURFACE INSPECTION ADJACENT OR IN A COIL AROUND A MANDREL

(71) Applicant: Novelis Inc., Atlanta, GA (US)

(72) Inventors: Roberto Armbrust de Freitas Quintal, Woodstock, GA (US); Luiz Alberto Murad Veiga, São Paulo (BR); Paul Blain Harlan, Dallas, GA (US); Felipe Mappa Franca Rocha, Acworth, GA (US); Young Taeg Park, YeongJu (KR); Rajbir Bal, Atlanta, GA (US); Renato Rufino Xavier, Kennesaw, GA (US); Stephan Haertel, Stassfurt (DE)

(73) Assignee: NOVELIS, INC., Atlanta, GA (US)

( * ) Notice: Subject to any disclaimer, the term of this patent is extended or adjusted under 35 U.S.C. 154(b) by 58 days.

(21) Appl. No.: 17/653,934

(22) Filed: Mar. 8, 2022

(65) Prior Publication Data

US 2022/0288662 A1 Sep. 15, 2022

Related U.S. Application Data

(60) Provisional application No. 63/200,466, filed on Mar. 9, 2021.

(51) Int. Cl.
*B21C 51/00* (2006.01)
*B21C 47/06* (2006.01)

(52) U.S. Cl.
CPC ..... *B21C 51/00* (2013.01); *B21C 47/06* (2013.01)

(58) Field of Classification Search
CPC ..... B21C 51/00; B21C 47/02; B21C 47/04; B21C 47/06; B21B 38/02;
(Continued)

(56) References Cited

U.S. PATENT DOCUMENTS 4,836,680 A * 6/1989 Troster ..... G01B 11/16 356/613
2004/0244450 A1* 12/2004 Armenat ..... B21C 47/063 72/11.7

FOREIGN PATENT DOCUMENTS

KR 10-2004-0056097 A * 6/2004 ..... B21C 51/00

OTHER PUBLICATIONS

ISRA Vision Parsytech, "Constant Pass-line Distance Technology—Coil Up, Coil Down—We Inspect" (available at least as early as Aug. 13, 2020) 2 pages.

(Continued)

*Primary Examiner* — Katrina M Stransky
*Assistant Examiner* — P Derek Pressley
(74) *Attorney, Agent, or Firm* — Kilpatrick Townsend & Stockton LLP

(57) ABSTRACT

A strip of metal entering or exiting a mill can be redirected about a roller so as to define an angled segment of the strip of metal, with the angled segment extending away from the roller and arranged at an angle relative to the roller. The angled segment can be connected with a coil that is rotated about a mandrel such that a magnitude of the angle of the angled segment changes as the coil is enlarged or reduced by the rotating of the mandrel. A sensor of a surface inspection system can detect a characteristic of a surface of the strip of metal in the angled segment or in the coil. The sensor can be robotically moved to modify a distance and/or an orientation of the sensor of the surface inspection system relative to the surface.

16 Claims, 10 Drawing Sheets

(58) Field of Classification Search
CPC .... B21B 2015/0057; B21B 2015/0064; G01B 5/28; G01B 21/30
USPC ..... 72/146
See application file for complete search history.

(56) References Cited

OTHER PUBLICATIONS

ISRA Vision, "New Constant Pass-Line Distance System Monitors Correct Winding Process," (Feb. 25, 2019), 5 pages, https://news.thomasnet.com/fullstory/new-constant-pass-line-distance-system-monitors-correct-winding-process-40021452.

* cited by examiner

ROBOTIC SURFACE INSPECTION ADJACENT OR IN A COIL AROUND A MANDREL

CROSS REFERENCE TO RELATED APPLICATIONS

This application claims the benefit of and priority to U.S. Provisional Application No. 63/200,466, filed Mar. 9, 2021, which is incorporated herein by reference in its entirety.

FIELD

The present disclosure relates to metalworking generally and more specifically to systems and methods relating to surface inspection of metal strips, such as relative to metal strips in or adjacent a coil around a mandrel.

BACKGROUND

To transport sheets or other layers of metal or other material more easily, the material can be coiled around a rotating mandrel. The resulting coil typically can be moved more easily than if the material is transported instead as one or more flat sheets or layers.

In use, coils may be generated in one stage and transported to another stage of production where the coil may be unwound and fed through a subsequent mill or other processing equipment. In view of the potential for multistage processing, evaluation of coil quality may be desirable to avoid processing coils that may be unsuitable for other processing stages. However, testing characteristics of a metal strip in a given coil may be difficult to achieve during processing of the strip before being coiled into the coil due to various factors such as space constraints and/or harsh conditions within the mill or other processing equipment.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings, and each claim.

Certain examples herein address systems and methods for detecting one or more characteristics of a strip of metal or other material during production or processing of the strip into or from a coil. The detected characteristics may include surface characteristics (such as smoothness, scratches, surface defects, surface roughness, or other surface qualities) or other characteristics (such as temperature or other qualities). The detection may be performed, for example, on an outer surface of the coil, or in an angled segment of the strip that may be connected with the coil and subject to changes in orientation as the coil changes size.

The detection may be performed outside of a mill used to process the strip. For example, en route when entering or exiting the mill, the strip can be redirected about a roller. Redirecting the strip about the roller may define the angled segment of the strip. The angled segment at one end can extend away from the roller and be arranged at an angle relative to the roller. The angled segment at an opposite end can also be connected to the coil. The coil can be formed around or otherwise mounted on a rotatable mandrel. As the mandrel rotates, the coil can change size (e.g., expand or shrink) and correspondingly cause a height and/or an angle of the angled segment to change (e.g., relative to a floor or other fixed reference point). To accommodate variations in the height and/or the angle of the angled segment and/or the dimension or other form factor of the coil, the detection can be performed by at least one sensor that is adjustable in position and orientation by a robotic arm or other robotic assembly. For example, as the angle of the angled segment increases, the robotic assembly may adjust the height and/or the angular orientation of the sensor to match the angle of the angled segment. The robotic assembly may also allow the sensor to move to different positions or orientations relative to the angled segment or the coil to, for example, facilitate or maintain suitable placement relative to the surface to be detected. This may allow consistent readings from the detected surfaces, for example, by maintaining constant distance from the surface to be detected and/or maintaining a constant perpendicular or other orientation relative to the detected surface.

The robotic assembly may also facilitate movement between different locations for detecting different parts of the strip. As one example, the robotic assembly may initially position the sensor above the strip (e.g., over the angled segment) and detect the characteristic along the top side of a strip, then subsequently move the sensor to underneath the strip to detect the characteristic along the bottom side of the strip. Additionally or alternatively, a first robotic arm may include a first sensor for the top side of the strip, and a second robotic arm may include a second sensor for the bottom side of the strip. In some examples, a first sensor for the top side and a second sensor for the bottom side may both be supported by a single robotic arm, e.g., via a bracket that supports the first sensor and the second sensor in an arrangement spaced apart by a slot in which the strip can be positioned.

In some examples, the robotic assembly can permit detection of the characteristic at an outer surface of the coil that may correspond to the top or the bottom of the strip (e.g., depending on the orientation of the coil, such as whether the coil is being wrapped in an overhand or underhand configuration). In addition to detecting the top or the bottom of the strip by detecting the outer surface of the coil, the robotic assembly may also allow the sensor to be repositioned to detect the opposite side of the coil in a detection of the angled segment of the strip connected with the coil.

In some examples, the detection may utilize multiple sensors or other suitable structures so that the outer surface of the coil and a portion of the angled segment can be sensed or detected at the same time, such as in response to sensor input from multiple sensors mounted on a single robotic arm with the multiple sensors aimed simultaneously at the coil and at the angled segment. In some examples, a first sensor of the multiple sensors may be pointed at the outer surface of the coil and a second sensor of the multiple sensors may be pointed at the portion of the angled segment.

Different sequences of detection may be utilized and may provide adequate detection within a production run in which one or more coils are generated. In some examples, the detection may be conducted relative to a first portion of the width of the strip and progress to an adjacent portion of the width and so on. This may provide different detections at different parts of the width without involving a sensor capable of detecting the entire width at once. In some examples, one side of a coil (e.g., the top or the bottom) may be detected during production of one portion of a coil (e.g., the first half) and then another side (e.g., the other of the top or bottom) may be detected during production of a subsequent portion (e.g., the second half) of the coil. In some examples, multiple coils may be generated one after another within a single production run, e.g., such that it may be suitable to test a top side in one coil and the bottom side in another coil to ensure quality through the overall batch of coils in a production run.

In various examples, a system is provided. The system may include a roller about which a strip of metal is redirected so as to define an angled segment of the strip of metal. The angled segment may be extending away from the roller and arranged at an angle relative to the roller. The system may also include a mandrel about which a coil is formed. The mandrel may be rotatable to change a size of the coil by at least one of winding or unwinding. The coil may be connected with the angled segment of the strip of metal such that a magnitude of the angle of the angled segment changes as the coil is enlarged or reduced by rotation of the mandrel. The system may also include a surface inspection system that includes at least one sensor operable to detect a characteristic of a surface of the strip of metal. The surface may be defined in the angled segment or in the coil. The system may also include a robotic assembly movable to modify an orientation of the at least one sensor of the surface inspection system relative to the surface.

In various examples, a method is provided. The method may include redirecting a strip of metal about a roller so as to define an angled segment of the strip of metal. The angled segment may be extending away from the roller and arranged at an angle relative to the roller. The method may also include rotating a mandrel to change a size of a coil connected with the angled segment of the strip of metal such that a magnitude of the angle of the angled segment changes as the coil is enlarged or reduced by the rotating of the mandrel. The method may also include detecting a characteristic of a surface of the strip of metal via at least one sensor of a surface inspection system. The surface may be defined in the angled segment or in the coil. The method may also include robotically moving the at least one sensor to modify an orientation of the at least one sensor of the surface inspection system relative to the surface.

In various examples, a robotic assembly is provided. The robotic assembly may include a surface inspection unit. The robotic assembly may also include a robotic manipulator coupleable with the surface inspection unit to manipulate an angular orientation of the surface inspection unit. The robotic assembly may also include a controller operatively coupleable with the robotic manipulator to cause the robotic manipulator to alter the angular orientation of the surface inspection unit relative to at least one of an angled segment of a metal strip subject to a change in angle during processing or a coil subject to a change in size during rotation of the coil about a mandrel.

Other objects and advantages will be apparent from the following detailed description of non-limiting examples.

BRIEF DESCRIPTION OF THE FIGURES

The specification makes reference to the following appended figures, in which use of like reference numerals in different figures is intended to illustrate like or analogous components.

DETAILED DESCRIPTION

As used herein, the terms "invention," "the invention," "this invention," and "the present invention" are intended to refer broadly to all of the subject matter of this patent application and the claims below. Statements containing these terms should be understood not to limit the subject matter described herein or to limit the meaning or scope of the patent claims below. The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. As used herein, the meaning of "a," "an," and "the" includes singular and plural references unless the context clearly dictates otherwise.

In material processing and production, continuous casting processes or rolling processes (e.g., hot rolling) can result in a coiled product. Material processing may correspond to or include metal processing. For example, the metal processing may produce a coiled strip of material. Suitable material may include articles of any suitable thickness capable of being coiled. A coiled strip can have any suitable length or width. A coil can comprise or correspond to a strip coiled. For example, a metal coil can comprise a metal strip that is coiled around a mandrel.

While certain aspects of the present disclosure may be suitable for use with any type of material, such as metal, certain aspects of the present disclosure may be especially suitable for use with aluminum.

The following examples will serve to further illustrate the present invention without, at the same time, however, constituting any limitation thereof. On the contrary, it is to be clearly understood that resort may be had to various embodiments, modifications, and equivalents thereof which, after reading the description herein, may suggest themselves to those skilled in the art without departing from the spirit of the invention.

Figure 1B:
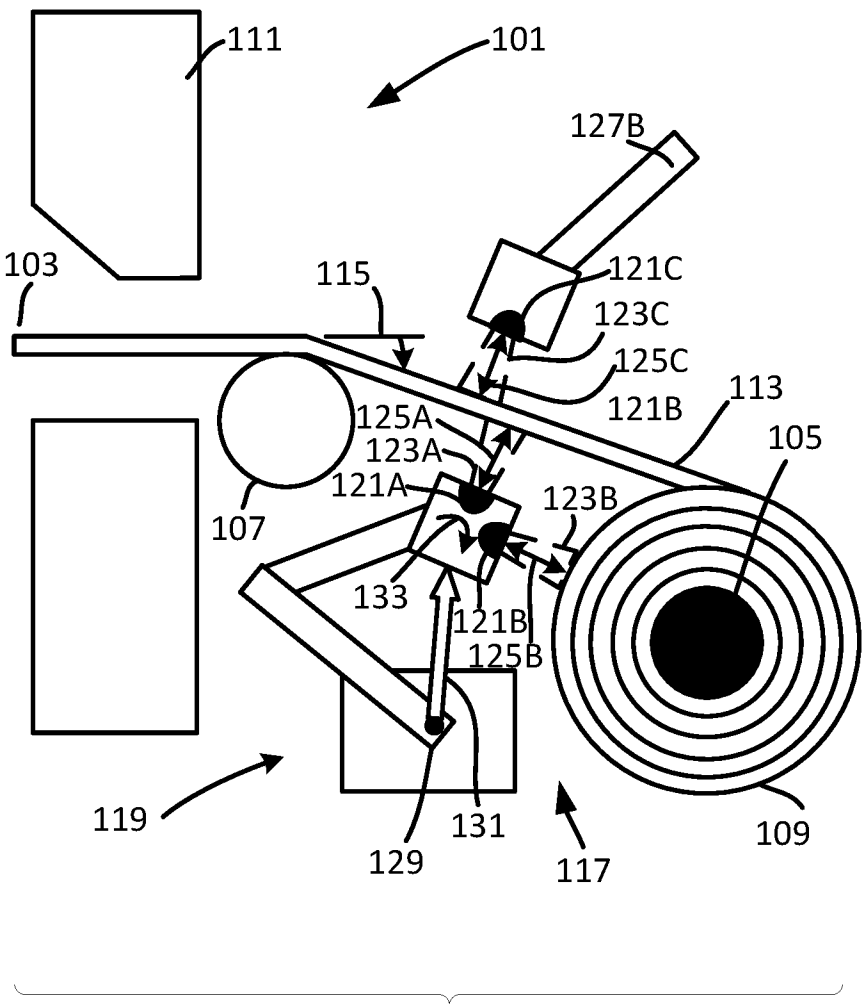
FIGS. 1A and 1B are side views illustrating a system for processing a strip of material according to various examples.
Figure 1A:
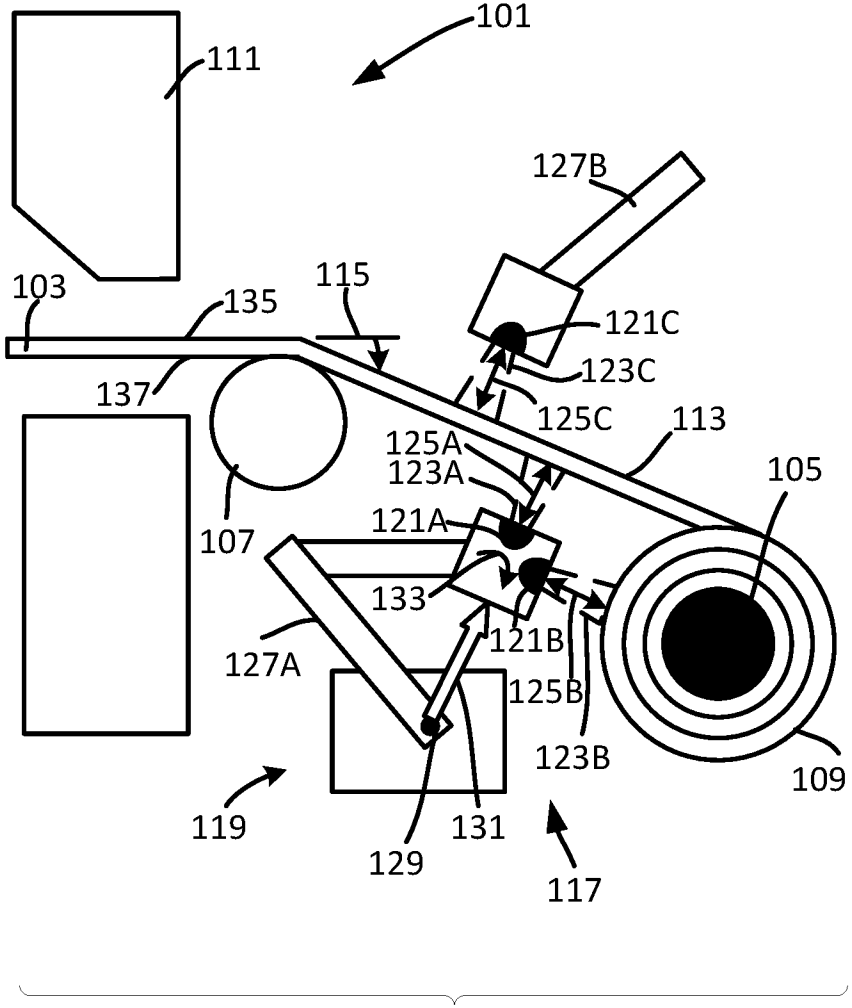

FIGS. 1A and 1B depict a side view of a system 101 for processing a strip of material 103. The strip of material 103 can be a strip of metal, for example. The system 101 as depicted in FIGS. 1A and 1B includes a mandrel 105 and a roller 107. However, the system 101 may include any number and variety of suitable elements. The strip of material 103 can be formed into a coil 109 about the mandrel 105. In FIG. 1A, the coil 109 is depicted as a first, smaller size, and in comparison, in FIG. 1B, the coil 109 is depicted as a second, larger size (e.g., which may correspond to the same coil 109 at different times within a processing operation).

The mandrel 105 in FIG. 1A is depicted as having a cylindrical shape. However, the mandrel 105 may be any shape suitable for rotating and receiving the strip of material 103. The mandrel 105 may have a length that is approximately equal to or greater than the width of a strip of material 103. In other embodiments, the mandrel 105 may have a length shorter than the width of the strip of material 103. In some embodiments, the mandrel 105 may include a spool positioned between two stub mandrels. The spool may receive the leading edge of the strip of material 103 and the strip of material 103 may be coiled around the spool. The mandrel 105 may be rotatable around a central axis by a motor or other suitable driving mechanism. The mandrel may be rotatable at variable speeds. For example, the mandrel 105 may have a linear surface speed in the range of 10 to 250 meters per minute. However, the upper and/or the lower bounds of the range may vary by 10% to 15% or other amounts.

The mandrel 105 may be positioned in the system 101 to receive the strip of material 103 onto a surface of the mandrel 105. For example, the mandrel 105 may be at a position that allows a leading portion of the strip of material 103 to contact the exterior of the mandrel 105. The mandrel 105 may be made of material that supports the strip of material 103 as it is coiled around the mandrel 105. The mandrel 105 may be or include, for example, carbon, steel, iron, metal, metal alloys, or any combination of materials suitable for supporting a coiled strip of material 103.

The system 101 may further include a roller 107. The roller 107 may be rotatable, static, or pivotable. The roller 107 may be cylindrical or any other shape suitable for supporting the strip of material 103 while it is being processed. In various embodiments, the roller 107 may correspond to or comprise a second mandrel 105. The coil 109 may correspond to overlapping turns of the strip of material 103.

The coil 109 may be processed relative to a mill 111. For example, the mill 111 may output the strip of material 103 and route the strip of material 103 (e.g., along roller 107) toward the mandrel 105. Although discussion here will primarily refer to arrangements in which the strip of material 103 is output from the mill 111 to generate a coil 109 about the mandrel 105, arrangements may also include an opposite process flow, e.g., where the coil 109 is unwound from the mandrel 105 for routing into the mill 111. Thus, for example, FIG. 1B may precede FIG. 1A in a process in which the coil 109 is unwound from the mandrel 105 and directed into the mill 111, or FIG. 1A may precede FIG. 1B in a situation in which the coil 109 is generated and enlarged around the mandrel 105 in operation. Any suitable direction of rotation (e.g., clockwise or counterclockwise) can be utilized for the mandrel 105 according to the particular application.

The mill 111 may correspond to any processing machinery (e.g., which may correspond to or include any number of stands, rollers, pinchers, or other components capable of processing a strip of material 103). Suitable examples may include hot roll mills or cold roll mills. The strip of material 103 may be arranged in a substantially horizontal orientation within the mill 111 and/or when entering or exiting the mill 111.

The roller 107 may redirect the strip of material 103. For example, when the strip of material 103 is output from the mill 111, the strip of material 103 may be redirected to define an angled segment 113 of the strip of material 103 due to passage along or about the roller 107. The angled segment 113 can extend away from the roller 107 and can be arranged at an angle 115 relative to the roller 107. The angled segment 113 can extend between the roller 107 and the coil 109. For example, the coil 109 may be fed or supplied by the angled segment 113. The relationship between the angled segment 113 and the coil 109 may cause a magnitude of the angle 115 of the angled segment 113 to change as the size of the coil 109 changes in response to the rotation of the mandrel 105. One example of such change in the angle 115 may be appreciated with reference to FIG. 1A and FIG. 1B in which the angle 115 is less steep in FIG. 1B as the coil 109 has been enlarged relative to the size shown in FIG. 1A.

The system 101 can further include a surface inspection system 117 and a robotic assembly 119. The surface inspection system 117 can be capable of detecting a characteristic of the strip of material 103. The detected characteristics may include surface characteristics (such as smoothness, scratches, surface defects, surface roughness, or other surface qualities) or other characteristics (such as temperature or other qualities), for example. The surface inspection system 117 in FIG. 1A is depicted with a sensor 121A positioned with a field of view 123A directed toward an underside of the angled segment 113. The sensor 121A can be positioned at a suitable distance 125*a* for detecting a characteristic of the strip of material 103.

Any suitable sensing technology can be utilized for the sensor 121A and/or the surface inspection system 117. In various examples, the surface inspection system 117 may utilize non-contact sensing components that need not physically contact the strip of material 103 for detection. In various examples, the surface inspection system 117 utilizes a camera or other optical sensor. An optical sensor may provide information indicative of a surface finish or other characteristic of the surface of the strip of material 103, for example. In this way, the surface inspection system 117 may allow detection of the presence of surface defects. For example, information from the optical sensor may be communicated to suitable hardware and/or software capable of evaluating image data for detecting and classifying surface defects. Detection of surface defects may allow production of a coil 109 to be aborted or adjusted to address the defect and prevent waste, for example. Additionally or alternatively, optical sensors and/or other elements that may be included in the surface inspection system 117 may provide information about a distance from a surface and/or other information.

In some examples, an optical sensor may include or be associated with a light source, e.g., such that the optical sensor registers light reflected from the light source. In some examples, an optical sensor may additionally or alternatively register ambient light.

In some examples, the surface inspection system 117 may be capable of obtaining temperature or other thermal information. For example, the surface inspection system 117 may utilize a thermal camera, a pyrometer, or another thermal sensor. In some examples, the surface inspection system 117 may include a roughness sensor. In some examples, the surface inspection system 117 may utilize a probe or other contact sensor. The surface inspection system 117 may utilize a single type of sensor or multiple types of sensors.

The robotic assembly 119 can include suitable elements for repositioning elements of the surface inspection system 117. For example, in FIG. 1A, a robot arm 127*a* is shown supporting the sensor 121A. Although the robotic assembly 119 is depicted in FIG. 1A with the robotic arm 127A, any form of robotic manipulator or any other robotic assembly 119 can be implemented to provide a suitable number of degrees of freedom for suitably positioning and/or orienting elements of the surface inspection system 117. In various examples, the robotic arm 127A or other element of the robotic assembly 119 may be capable of changing a position and/or orientation of the sensor 121A relative to a base or other reference point 129. For example, the sensor 121A may be repositioned and/or re-oriented to accommodate the change in the angle 115 of the angled segment 113 as the mandrel 105 rotates and changes the size of the coil 109.

In various examples, the robotic assembly 119 can facilitate movement of elements of the surface inspection system 117 so that the distance 125*a* and/or orientation of the sensor 121A can be reestablished or maintained to match the orientation of the angled segment 113. An example of this is graphically represented in FIGS. 1A and 1B, where the distance 125*a* in each figure is the same as in the other figure, while the orientation of the sensor 121A is maintained substantially perpendicular to the surface of the angled segment 113. Such re-orientation may be a result of the movement of the robot arm 127 that has resulted in a change of orientation and/or position relative to the reference point 129 (e.g., as illustrated by the difference in a magnitude and/or direction of a vector 131 in FIG. 1A compared to in FIG. 1B).

The surface inspection system 117 may additionally or alternatively be utilized to detect a surface of the coil 109. For example, a second field of view 123*b* and a second distance 125*b* from the coil 109 are depicted in FIG. 1A. In some examples, the second field of view 123*b* may be obtained by movement of the first sensor 121A, which may be facilitated by movement of the robotic assembly 119. For example, the second field of view 123*b* may be accomplished by rotation, such as depicted by arrow 133, although any form of movement for reorientation may be utilized.

Additionally or alternatively, the second field of view 123*b* may be provided by a second sensor 121*b* that may be included as a part of the surface inspection system 117. Use of the first sensor 121A and the second sensor 121B (or of some other set of multiple sensors) may facilitate simultaneous detection of different portions of the strip of material 103.

In various examples, the surface inspection system 117, in conjunction with the robotic assembly 119, can facilitate detection of multiple sides of the strip of material 103. For example, the strip of material 103 upon exiting the mill 111 may include a top face 135 and a bottom face 137. In the arrangement shown in FIG. 1A, the top face 135 can be detected by detecting a surface of the coil 109 (such as by the second field of view 123*b*), while the bottom face 137 can be detected along the angled segment 113 on an underside of the angled segment 113 by the first field of view 123*a*. In some arrangements, a detection of the top face 135 of the angled segment 113 may be sensed by another sensor 121*c* at a corresponding distance 125*c* and field of view 123*c* to facilitate detection of the top face 135 of the strip of material 103. For example, the sensor 121*c* can be mounted on an additional robotic manipulator 127*b* of the robotic assembly 119. Although the system 101 in FIG. 1A is depicted with two robotic arms 127, arrangements may utilize only one arm, more than two arms, or other structure other than robotic arms within the robotic assembly 119. Moreover, although three sensors 121 are depicted in FIG. 1, any combination or subset could be utilized individually or in combination.

Moreover, in some examples, a single robotic manipulator (such as robot arm 127A) may be capable of obtaining not only the first field of view 123*a*, but also the third field of view 123*c*. For example, the robotic arm 127A may relocate the first sensor 121A from a position on the underside of the angled segment 113 to position over the angled segment 113.

Generally, the robotic assembly 119 may facilitate sequential detection of the top face 135 and the bottom face 137 or simultaneous detection depending on the arrangement and elements included. Examples of simultaneous detection may involve arrangements in which multiple sensors 121 are positioned on opposite sides of the angled segment 113 or in which sensors 121 are provided with fields of view of both the coil 109 and the angled segment 113. Examples of sequential detection may include arrangements in which a sensor 121 used to detect one side of the angled segment 113 is at another time positioned to either detect an opposite side of the angled segment 113 or positioned to detect the coil 109.

FIGS. 2A through 2D illustrate a variety of routing combinations that can be utilized with the system 101 of FIGS. 1A and 1B. FIGS. 2A through 2D illustrate that detection at the coil 109 may vary between detecting the top face 135 and the bottom face 137 depending on the routing utilized.

Figure 2A:
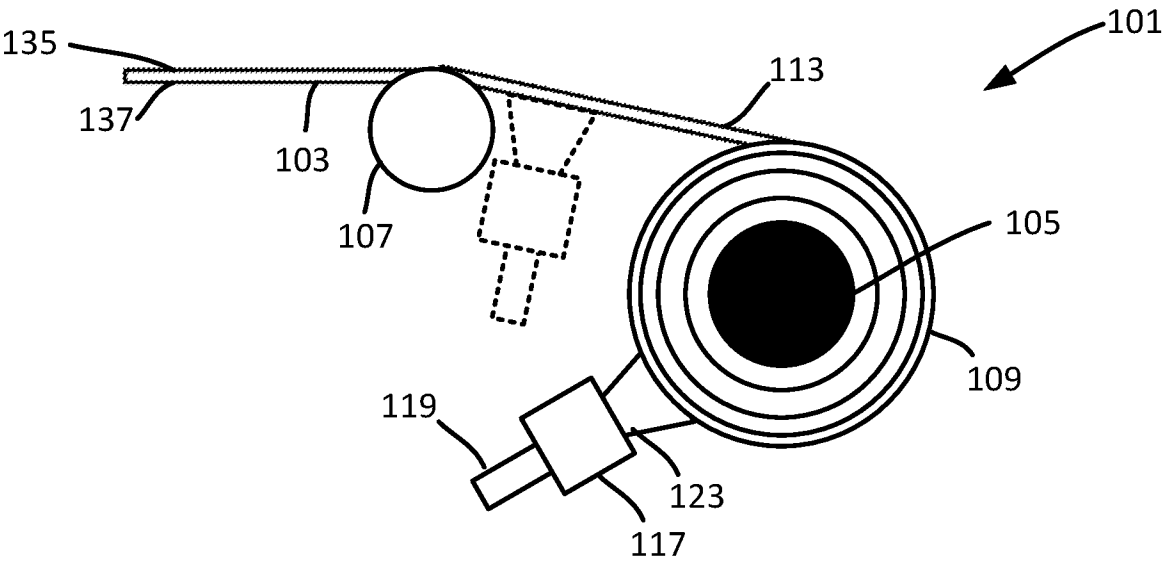
FIGS. 2A through 2D are side views illustrating a variety of routing combinations that can be utilized with the system of FIGS. 1A and 1B according to various examples.

For example, in FIG. 2A, the strip of material 103 is routed over the roller 107 or along an upper side of the roller 107 and approaches the mandrel 105 from above or in an overhand fashion. This can result in the top face 135 being detected by detection at the coil 109, as depicted in solid lines with respect to the surface inspection system 117 in FIG. 2A. Detection of the bottom face 137 may be facilitated by detecting an underside of the angled segment 113 in such routing, as depicted by the position shown in dashed lines in FIG. 2A.

Figure 2B:
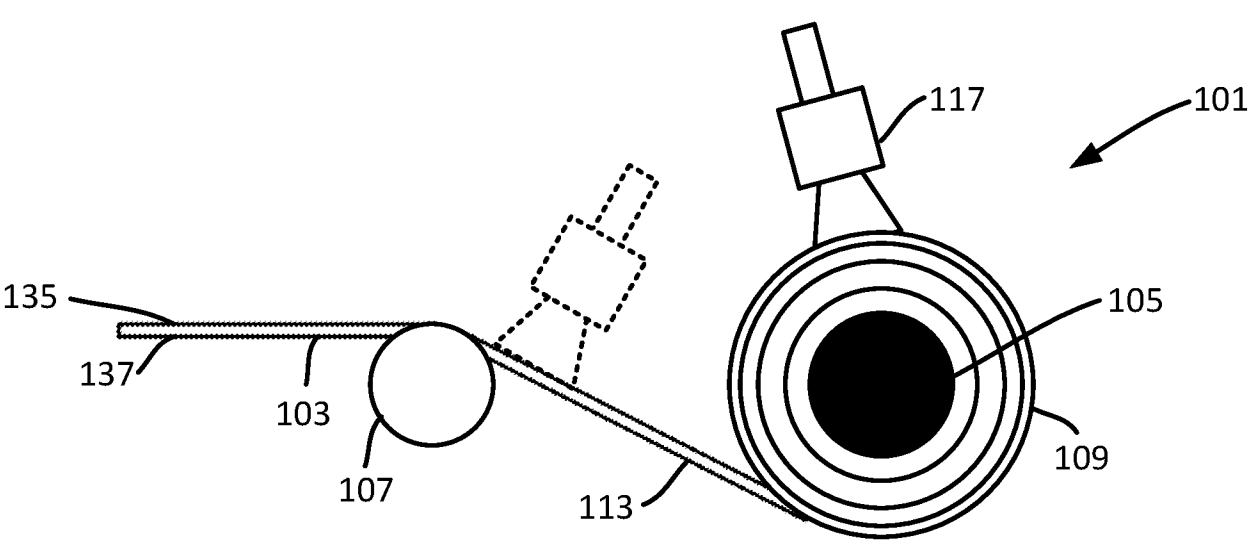

In contrast, in FIG. 2B, the strip of material 103 is routed over the roller 107 or along an upper-side of the roller 107 and approaches the mandrel 105 from below or in an underhand fashion. This can result in the bottom face 137 being detected by detection at the coil 109 as depicted in solid lines with respect to the surface inspection system 117 in FIG. 2B. Detection of the top face 135 may be facilitated by detecting along an upper side of the angled segment 113, as depicted by the position shown in dashed lines in FIG. 2B.

Figure 2C:
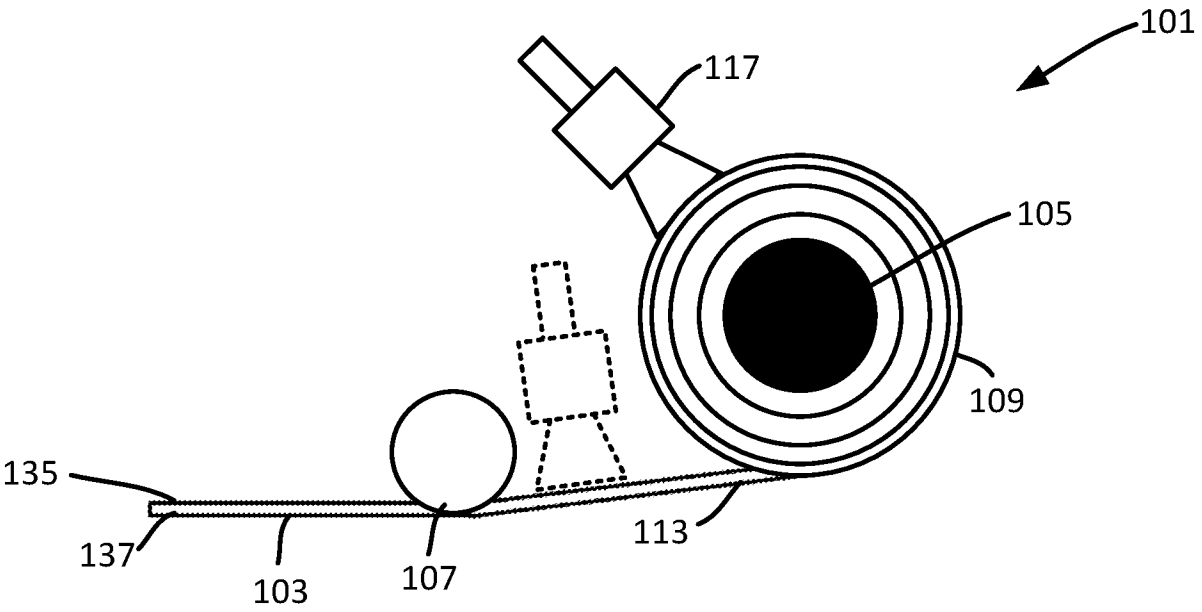

In FIG. 2C, the strip of material 103 is routed underneath the roller 107 or along an underside of the roller 107 and approaches the mandrel 105 from below or in an underhand fashion. This can result in the bottom face 137 being detected by detection at the coil 109 as depicted in solid lines with respect to the surface inspection system 117 in FIG. 2C. Detection of the top face 135 may be facilitated by detection along an upper side of the angled segment 113, as depicted by the position shown in dashed lines in FIG. 2C.

Figure 2D:
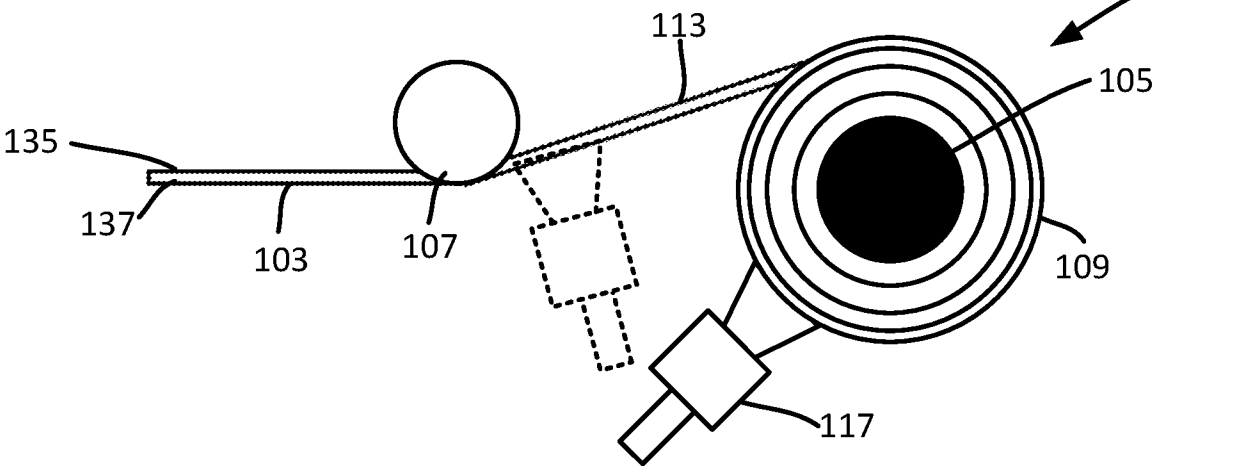

In FIG. 2D, the strip of material 103 is routed underneath the roller 107 or along an underside of the roller 107 and approaches the mandrel 105 from above or in an overhand fashion. This can result in the top face 135 being detected by detection at the coil 109 as depicted in solid lines with respect to the surface inspection system 117 in FIG. 2D. In such arrangements the bottom face 137 can be detected by sensing along an underside of the angled segment 113, such as depicted by the dashed lines in FIG. 2D.

Figure 3B:
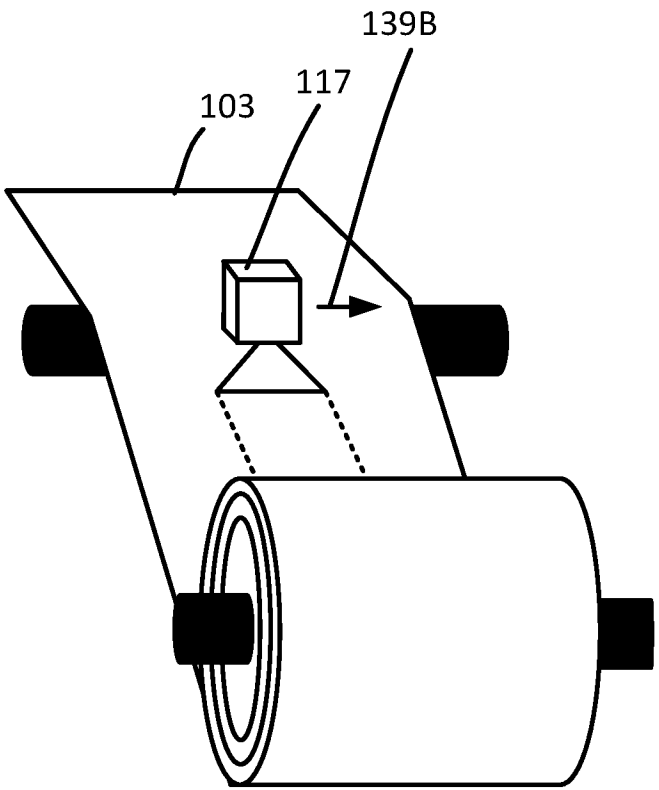
FIGS. 3A through 3C are perspective views of elements of the system from FIGS. 1A and 1B in various states in which the strip of material may be detected in portions corresponding to less than an entire width of the strip of material according to various examples.
Figure 3A:
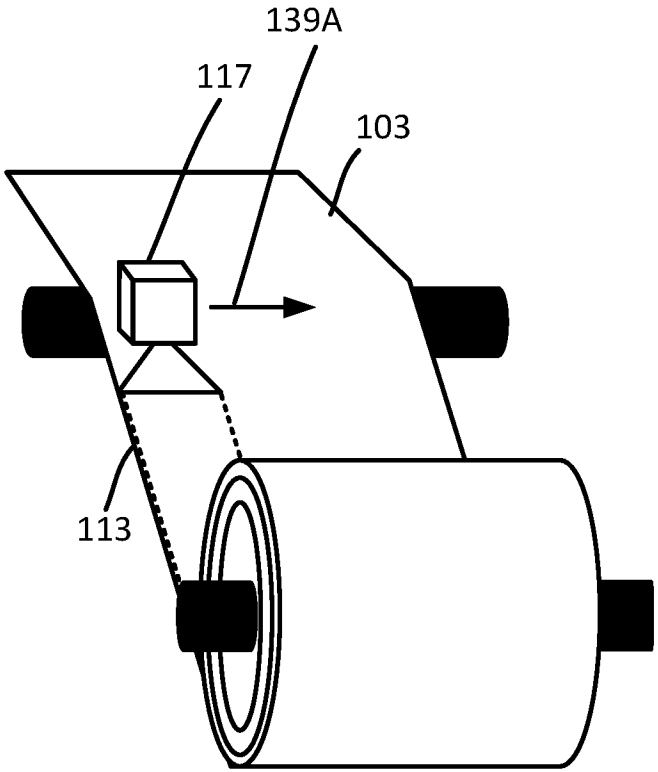
Figure 3C:
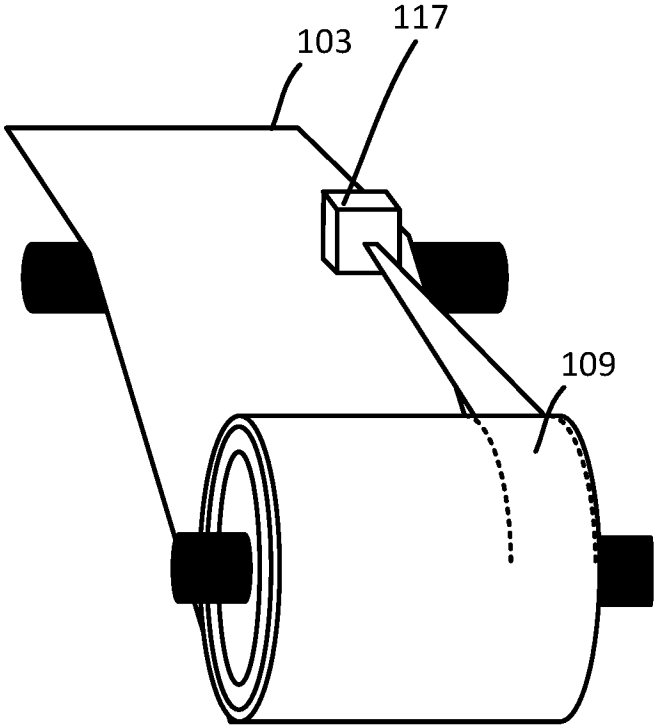

FIGS. 3A through 3C show perspective views of elements of the system 101 in various states in which the strip of material 103 may be detected in portions corresponding to less than an entire width of the strip of material 103. For example, in FIG. 3A the surface inspection system 117 may detect a first segment of the width (e.g., bounded by dashed lines in FIG. 3A) on the angled segment 113 during a first portion of the production process of producing one or more coils. Upon reaching a predetermined transition point in the production process (such as at the one half mark or other partial interval of one coil, or in between successive coils), the surface inspection system 117 may be moved (such as illustrated by arrow 139A) to a different portion of the width of the strip of material 103. For example, the surface inspection system 117 may be moved to a position depicted in FIG. 3B.

In FIG. 3B, the surface inspection system 117 may detect a surface characteristic of a central portion of the width for a predetermined portion of the production process before moving (such as illustrated by arrow 139B). Movement in such fashion may result in a position such as shown in FIG. 3C.

In FIG. 3C, the surface inspection system 117 may be altered in regards to orientation to detect the coil 109. In the example sequence, the surface inspection system 117 can accordingly detect different portions of the width of the strip of material 103 and may switch between detecting a top face 135 or a bottom face 137 based on switching between the angled segment 113 and the coil 109. Other variations of detecting less than an entire width of the strip of the material 103 may also be utilized.

Figure 4:
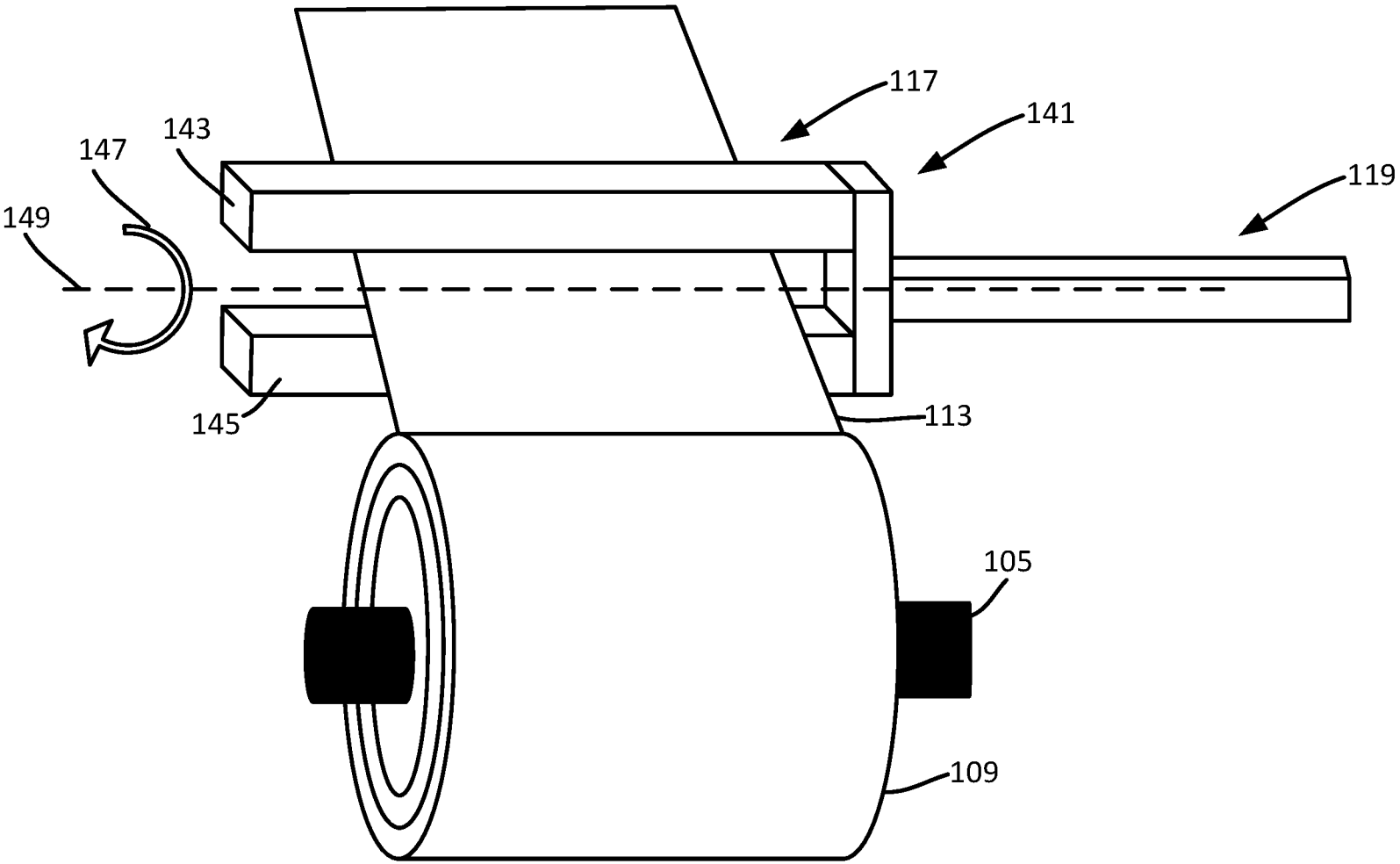
FIG. 4 is a perspective view illustrating an example of a multi-sided arrangement that may be utilized with the system of FIGS. 1A and 1B according to various examples.

FIG. 4 illustrates an example of a multi-sided arrangement that may be utilized with the system 101. In FIG. 4, a bracket 141 is provided. The bracket 141 can include an upper member 143 and a lower member 145. The upper member 143 and the lower member 145 may be spaced apart from one another by a slot sized for passage therethrough of the angled segment 113 or other portion of the strip of material 103. The upper member 143 and the lower member 145 can each include respective components of the surface inspection system 117. In this fashion, the bracket 141 may be utilized to detect both a top face 135 and a bottom face 137 of the strip of material 103 by using a single manipulator of the robotic assembly 119. In some examples, the robotic assembly 119 that supports the bracket 141 can be rotatable as illustrated by arrow 147 around a central axis 149. Such degrees of freedom may allow the robotic assembly 119 to move elements of the surface inspection system 117 to accommodate or match a change in angle of the angled segment 113 as the coil 109 changes size in response to rotation of the mandrel 105.

Figure 5A:
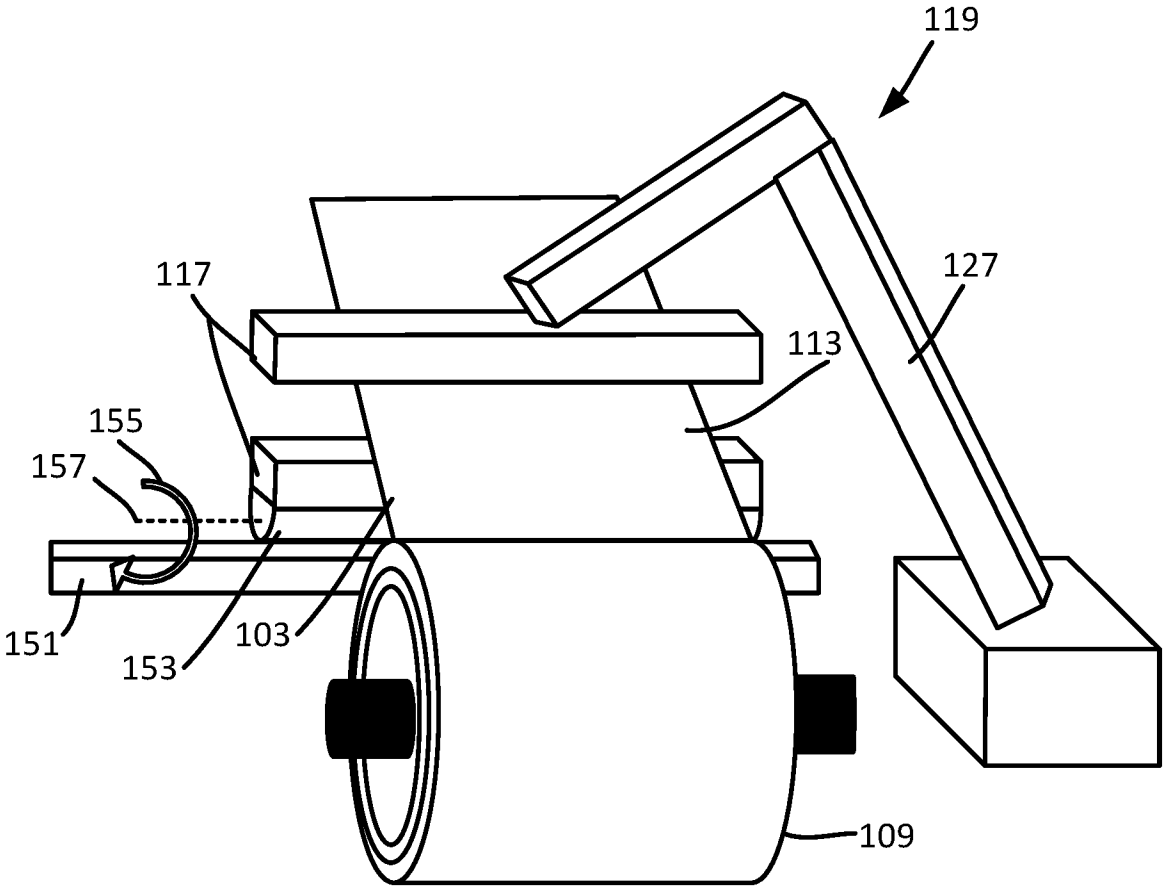
FIGS. 5A and 5B are perspective views illustrating respective operations and component positions of examples of elements that may be utilized in the system of FIGS. 1A and 1B according to various examples.
Figure 5B:
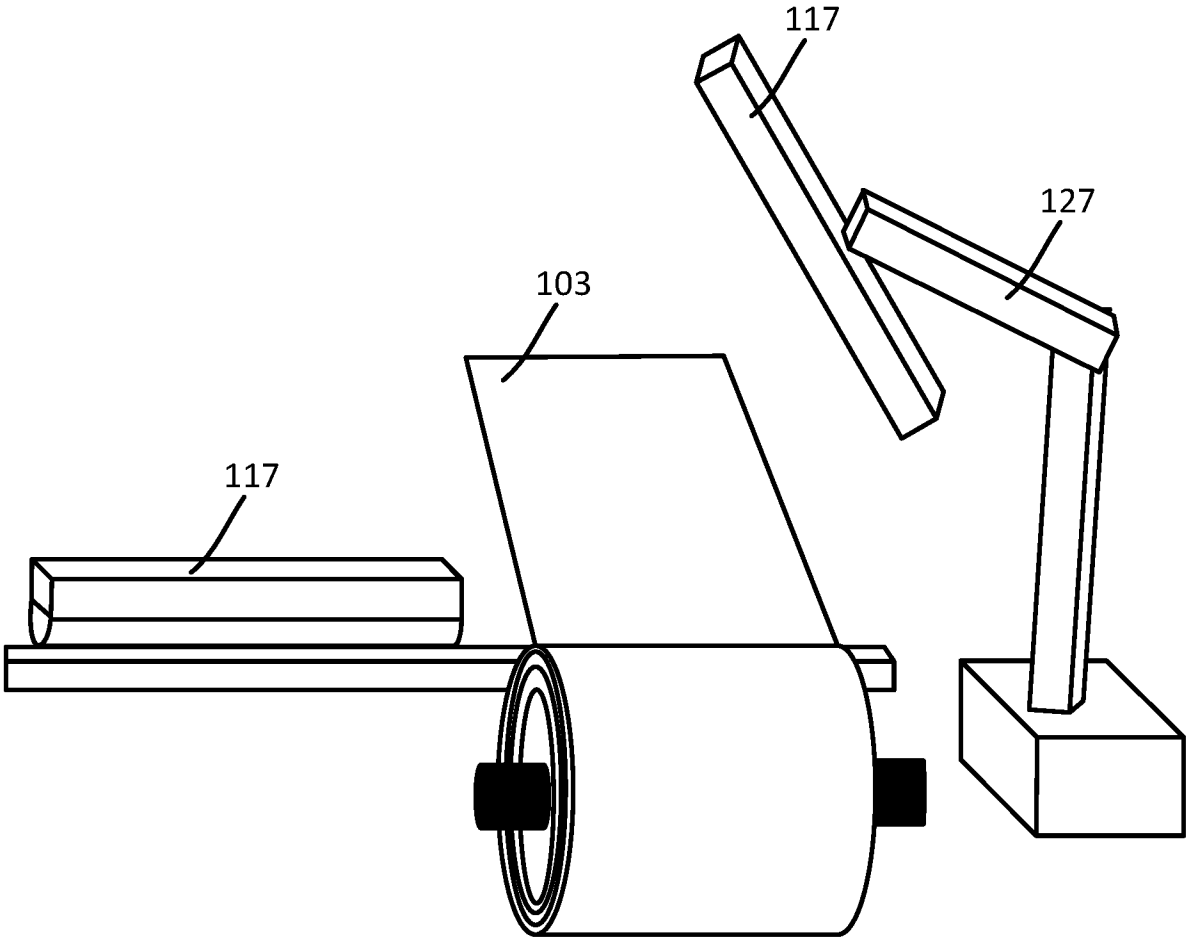

FIGS. 5A and 5B illustrate respective operations and component positions of examples of elements that may be utilized in the system 101. In FIG. 5A, the robotic assembly 119 includes a robotic arm 127 supporting an upper portion of the surface inspection system 117, while a lower portion of the surface inspection system 117 is supported relative to a track 151 that facilitates translation between positions adjacent the strip of material 103 (as in FIG. 5A) and away from the strip of material 103 (as in FIG. 5B). In FIG. 5B, the robotic arm 127 is illustrated as retracted from adjacent the strip of material 103. The parked position in FIG. 5B may be utilized to facilitate starting or ending conditions of the coil 109, such as to facilitate ease of routing of the strip of material 103 without constraints by the elements of the surface inspection system 117 or the robotic assembly 119. In FIG. 5A, the track 151 is also associated with an angularly adjustable mount 153. The angularly adjustable mount 153 may allow the associated element of the surface inspection system 117 to adjust in orientation relative to the strip of material 103. For example, such adjusting orientation may be in response to a change in the angle 115 of the angled segment 113 (as discussed with respect to FIG. 1A above). To facilitate such adjustment, the angularly adjustable mount 153 may be pivotable (such as illustrated by arrow 155) around an axis 157. FIGS. 5A and 5B illustrate by way of example that the robotic assembly 119 is not limited to robotic arms but may include any suitable set of actuators, tracks, or other structures with suitable degrees of freedom to enable positioning the elements of the surface inspections system 117 among different distances and orientations relative to the strip of material 103 as the strip of material 103 undergoes changes in orientation in the angled segment 113 and/or in the coil 109.

Figure 6:
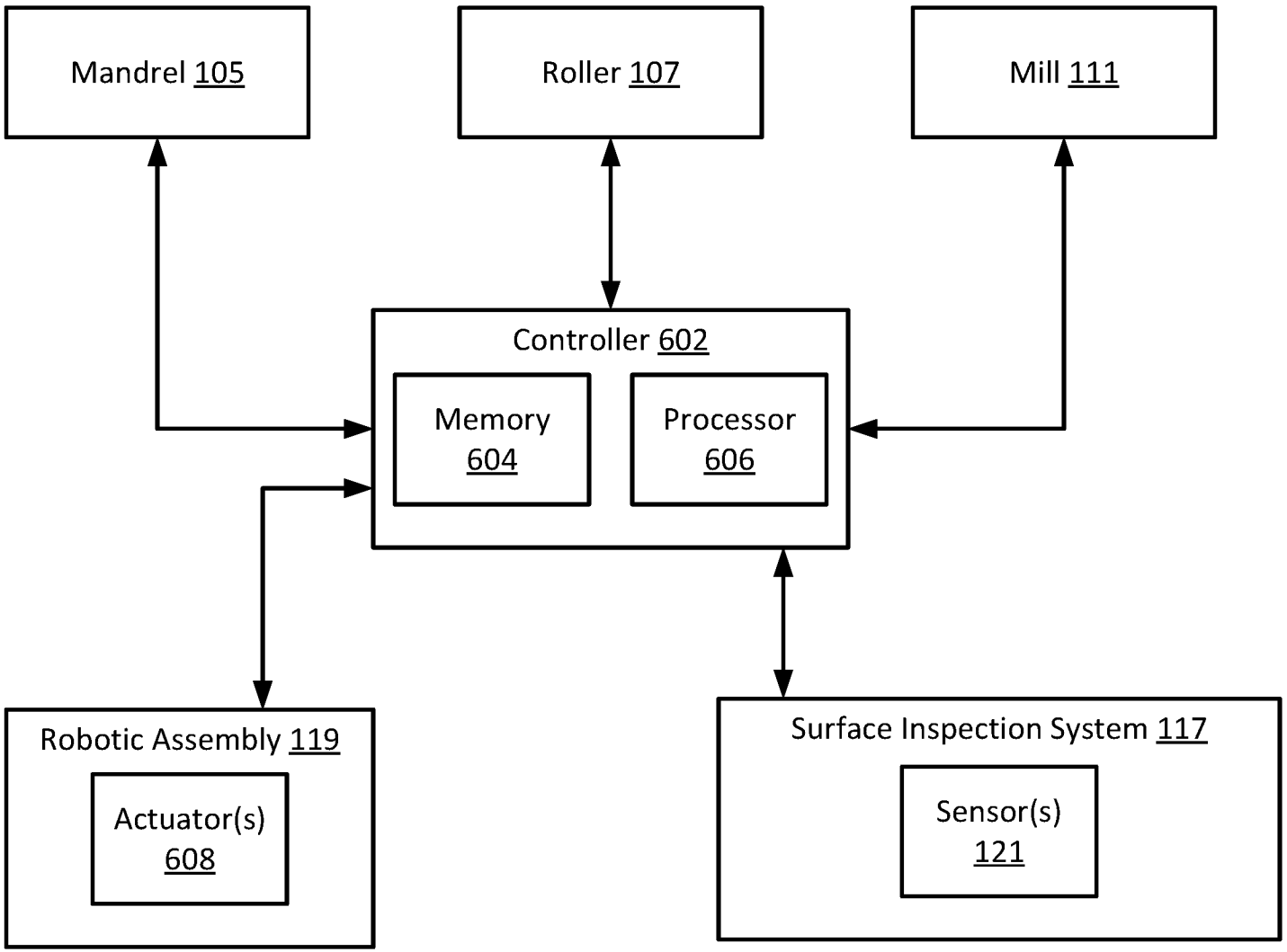
FIG. 6 is a simplified schematic diagram that illustrates examples of control aspects of the system of FIGS. 1A and 1B according to various examples.

FIG. 6 is a simplified schematic diagram that illustrates examples of control aspects of the system 101. A controller 602 can communicate information and/or instructions associated with the system 101. The controller 602 can be communicatively coupled to the mandrel 105, the roller 107, the mill 111, the surface inspection system 117, the robotic assembly 119, and/or other associated elements. The controller 602 can communicate via a wired or wireless connection, and the controller 602 can include memory 604 and a processor 606. The memory 604 and the processor 606 can be included in a single structure. However, the memory 604 and processor 606 may be part of a system of multiple interconnected devices.

The memory 604 can include any type of memory device that retains stored information when powered off. The memory 604 can be or include electrically erasable and programmable read-only memory ("EEPROM"), flash memory, or any other type of non-volatile memory. In some examples, at least part of the memory 604 can include a medium from which the processor 606 can read instructions. A non-transitory computer-readable medium can include electronic, optical, magnetic, or other storage devices capable of providing the processor 606 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

The processor 606 can execute instructions stored in the memory 604 to perform operations, for example, detecting the strip of material 103 and/or controlling operation of the robotic assembly 119. The processor 606 can include one processing device or multiple processing devices. Non-limiting examples of the processor 606 include a Field- Programmable Gate Array ("FPGA"), an application-specific integrated circuit ("ASIC"), a microprocessor, etc.

The controller 602 may communicate with, or otherwise control, the various components of the system 101. In one example relating to the mandrel 105, the controller 602 can determine a speed of rotation of the mandrel 105, can determine an amount of rotation completed by the mandrel 105, a combination thereof, or can determine other suitable measures relating to the mandrel 105. In this example, the controller 602, or the system 101, can determine a change of angle 115 of the angled segment 113 for detecting the angled segment of the strip of material 103. Additionally or alternatively, the controller 602 can communicate with, or otherwise control, the roller 107 and the mill 111 for determining speed, direction, or other suitable measurements to allow improved detection of the strip of material 103.

The surface inspection system 117 can include one or more sensors 121 that can be communicatively coupled to the controller 602. And, the robotic assembly 119 can include one or more actuators 608 for controlling the robotic assembly 119. The controller 602 can communicate with, or otherwise control, the robotic assembly 119 for detecting the strip of material 103. For example, the controller 602 can cause the actuators 608 to actuate to adjust a position or angle of components of the robotic assembly 119. In this example, a position or an angle of the sensors 121 may additionally be adjusted, which may improve detection of the angled segment. The sensors 121 may include a sensor that can determine distance, orientation, angle, or other measures of the components of the system 101. For example, the sensor can determine the distance, orientation, angle, or other measure of the strip of material 103, the mandrel 105, the roller 107, the mill 111, the surface inspection system 117, the robotic assembly 119, a combination thereof, or other suitable components. The sensor may provide information that can be used to determine where to move, or how to adjust, the sensors 121 for detecting the strip of material 103.

Figure 7:
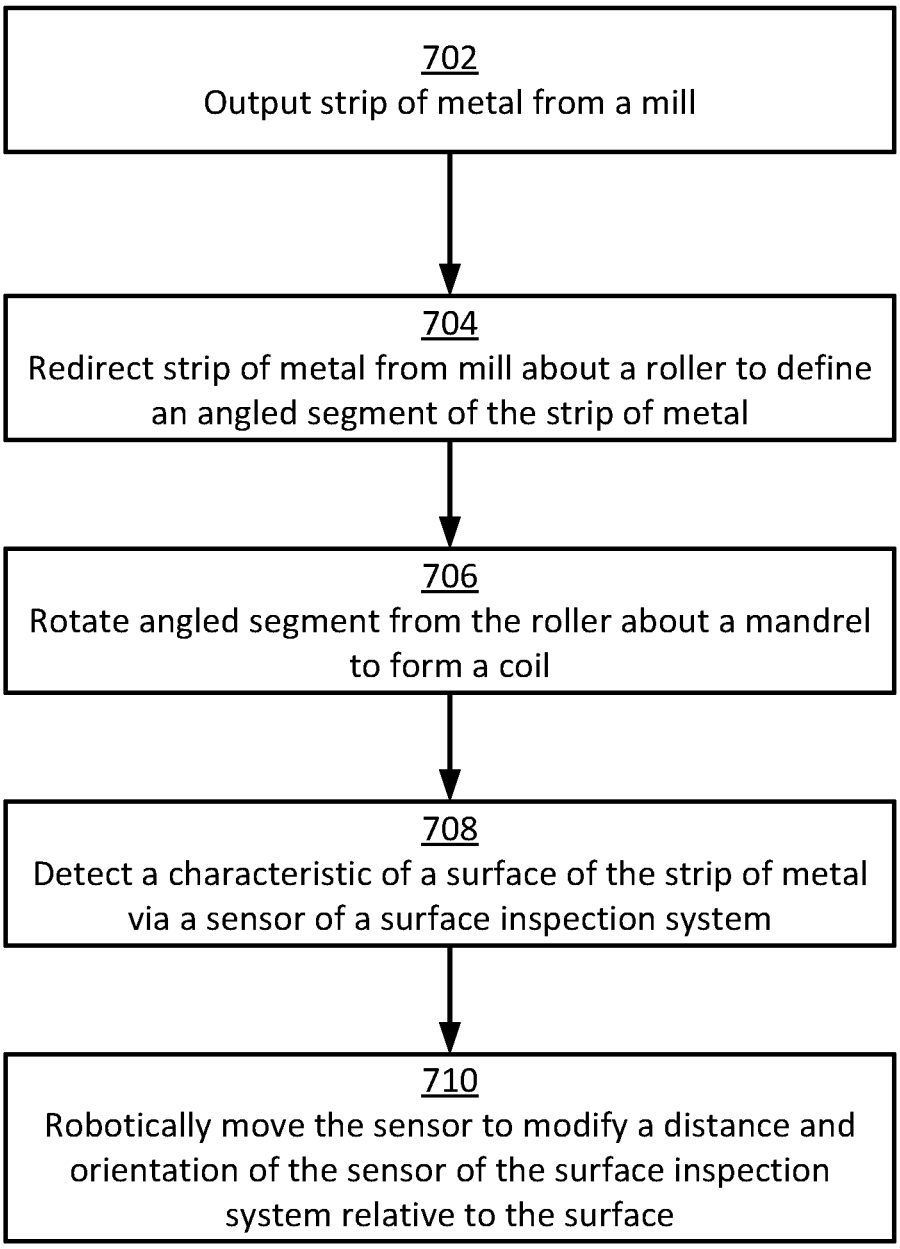
FIG. 7 is a flow chart illustrating a process that may be implemented relative to the system of FIGS. 1A and 1B according to various embodiments.

In FIG. 7, a flowchart illustrating a process 700 is shown, according to various embodiments. Various blocks of the process 700 are described by referencing the components shown in other figures herein, however, additional or alternative components may be used with the process.

The process 700 at block 702 can include outputting a strip of metal (e.g., a strip of material 103) from a mill (e.g., mill 111). The strip as output may include a top side and a bottom side (e.g., top face 135 and bottom face 137).

The process 700 at block 704 can include redirecting the strip of metal from the mill about a roller (e.g., roller 107) to define an angled segment (e.g., angled segment 113) of the strip of metal. Redirecting may include any combination of routing from FIGS. 2A through 2D, for example.

The process 700 at block 706 can include rotating the angled segment from the roller about a mandrel (e.g., mandrel 105) to form a coil (e.g., coil 109).

The process 700 at block 708 can include detecting a characteristic of a surface of the strip of metal via a sensor (e.g., sensor 121A, 121B, and/or 121B) of a surface inspection system (e.g., surface inspection system 117). For example, the detecting may utilize an optical sensor and/or any other form of sensor described herein. In some examples, the detecting may include detecting relative to a first subset of a width of the strip of metal during a first part of a production process (such as in a first coil or portion of a first coil in the production process) and detecting relative to a second subset of the width of the strip of metal during a second part of the production process (such as in a second portion of the first coil or in a different, second coil in the production process).

The process 700 at block 710 can include robotically moving (e.g., via the robotic assembly 119) the sensor to modify a distance and/or orientation of the sensor of the surface inspection system relative to the surface to be detected (e.g., in the angled segment 113 or in the coil 109). For example, this may involve the controller 602 responding to information about orientation of other elements and controlling the robotic assembly 119 to reposition and/or re-orient elements of the surface inspection system 117.

Illustrative Aspects

In some aspects, a device, a system, or a method is provided according to one or more of the following illustrative aspects or according to some combination of the elements thereof. In some aspects, features of a device or a system described in one or more of these aspects can be utilized within a method described in one of the other aspects, or vice versa.

Aspect 1 (which may include any features of any other subsequent aspects individually or in combination) is a system comprising: a roller about which a strip of metal is redirected so as to define an angled segment of the strip of metal, the angled segment extending away from the roller and arranged at an angle relative to the roller; a mandrel about which a coil is formed, the mandrel rotatable to change a size of the coil by at least one of winding or unwinding, the coil connected with the angled segment of the strip of metal such that a magnitude of the angle of the angled segment changes as the coil is enlarged or reduced by rotation of the mandrel; a surface inspection system comprising at least one sensor operable to detect a characteristic of a surface of the strip of metal, the surface defined in the angled segment or in the coil; and a robotic assembly movable to modify an orientation of the at least one sensor of the surface inspection system relative to the surface.

Aspect 2 is the system of aspect 1 (or of any other preceding or subsequent aspects individually or in combination), wherein the strip of metal comprises a top face facing upward and a bottom face facing downward, and wherein the robotic assembly facilitates detection by the at least one sensor of the top face and the bottom face.

Aspect 3 is the system of aspect 2 (or of any other preceding or subsequent aspects individually or in combination), wherein the robotic assembly facilitates sequential detection of the top face and the bottom face and is movable to arrange the surface inspection system in a first setting for detecting the top face and movable to arrange the surface inspection system in a second setting for detecting the bottom face.

Aspect 4 is the system of aspect 3 (or of any other preceding or subsequent aspects individually or in combination), wherein in the first setting the at least one sensor is detecting one of the angled segment or the coil and in the second setting the at least one sensor is detecting the other of the angled segment or the coil.

Aspect 5 is the system of aspect 3 (or of any other preceding or subsequent aspects individually or in combination), wherein in the first setting the sensor is one of above or below the angled segment and in the second setting the sensor is the other of above or below the angled segment.

Aspect 6 is the system of aspect 2 (or of any other preceding or subsequent aspects individually or in combination), wherein the at least one sensor comprises multiple sensors, and wherein the robotic assembly facilitates simultaneous detection of the top face and the bottom face by the multiple sensors.

Aspect 7 is the system of aspect 6 (or of any other preceding or subsequent aspects individually or in combination), wherein the multiple sensors comprise a first sensor for detecting the angled segment and a second sensor for detecting the coil.

Aspect 8 is the system of aspect 7 (or of any other preceding or subsequent aspects individually or in combination), wherein the robotic assembly comprises a robotic manipulator supporting the first sensor and the second sensor.

Aspect 9 is the system of aspect 6 (or of any other preceding or subsequent aspects individually or in combination), wherein the multiple sensors comprise an upper sensor positionable by the robotic assembly above the angled segment and a lower sensor positionable by the robotic assembly below the angled segment.

Aspect 10 is the system of aspect 9 (or of any other preceding or subsequent aspects individually or in combination), wherein the robotic assembly comprises: a first robotic manipulator supporting the upper sensor; and a second robotic manipulator supporting the lower sensor.

Aspect 11 is the system of aspect 9 (or of any other preceding or subsequent aspects individually or in combination), further comprising a bracket supported by the robotic assembly and comprising: an upper member supporting the upper sensor; a lower member supporting the lower sensor; and a slot defined between the upper member and the lower member and sized for passage of the angled segment therethrough.

Aspect 12 is the system of aspect 1 (or of any other preceding or subsequent aspects individually or in combination), wherein the surface is defined in the angled segment.

Aspect 13 is the system of aspect 1 (or of any other preceding or subsequent aspects individually or in combination), wherein the surface is defined in the coil.

Aspect 14 (which may include any features of any other preceding or subsequent aspects individually or in combination) is a method comprising: redirecting a strip of metal about a roller so as to define an angled segment of the strip of metal, the angled segment extending away from the roller and arranged at an angle relative to the roller; rotating a mandrel to change a size of a coil connected with the angled segment of the strip of metal such that a magnitude of the angle of the angled segment changes as the coil is enlarged or reduced by the rotating of the mandrel; detecting a characteristic of a surface of the strip of metal via at least one sensor of a surface inspection system, the surface defined in the angled segment or in the coil; and robotically moving the at least one sensor to modify an orientation of the at least one sensor of the surface inspection system relative to the surface.

Aspect 15 is the method of aspect 14 (or of any other preceding or subsequent aspects individually or in combination), wherein the detecting a characteristic comprises: detecting relative to a first subset of a width of the strip of metal during a first part of a production process; and detecting relative to a second subset of the width of the strip of metal during a second part of the production process.

Aspect 16 is the method of aspect 14 (or of any other preceding or subsequent aspects individually or in combination), wherein the strip of metal comprises a top face facing upward upon exiting a mill and a bottom face facing downward upon exiting the mill, and wherein the detecting a characteristic comprises: detecting relative to the top face during a first part of a production process that involves a first coil; and detecting relative to bottom face during a second part of the production process that involves a second coil.

Aspect 17 (which may include any features of any other preceding or subsequent aspects individually or in combination) is a robotic assembly comprising: a surface inspection system; a robotic manipulator coupleable with the surface inspection unit to manipulate an angular orientation of the surface inspection unit; and a controller operatively coupleable with the robotic manipulator to cause the robotic manipulator to alter the angular orientation of the surface inspection unit relative to at least one of an angled segment of a metal strip subject to a change in angle during processing or a coil subject to a change in size during rotation of the coil about a mandrel.

Aspect 18 is the robotic assembly of aspect 17 (or of any other preceding or subsequent aspects individually or in combination), wherein the surface inspection system comprises at least one sensor that comprises at least one of: a thermal camera, a pyrometer, or another thermal sensor; a roughness sensor; or an optical sensor.

Aspect 19 is the robotic assembly of aspect 17 (or of any other preceding or subsequent aspects individually or in combination), wherein the surface inspection system comprises: a first sensor configured for providing information about a surface characteristic of the angled segment or the coil; and a second sensor configured for providing information about an orientation and a distance of the surface inspection unit relative to the angled segment or the coil.

Aspect 20 is the robotic assembly of aspect 17 (or of any other preceding or subsequent aspects individually or in combination), wherein the controller is configured to control the robotic manipulator at least in part in response to information about an arrangement of the angled segment or the coil, the information about the arrangement being derived from information about rotation of a mandrel that changes at least one of the size of the coil or the orientation of the angled segment.

All patents, publications, and abstracts cited above are incorporated herein by reference in their entirety. The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

What is claimed is:

1. A system comprising:

a roller about which a strip of metal is redirected so as to define an angled segment of the strip of metal, the angled segment extending away from the roller and arranged at an angle relative to the roller;

a mandrel about which a coil is formed, the mandrel rotatable to change a size of the coil by at least one of winding or unwinding, the coil connected with the angled segment of the strip of metal such that a magnitude of the angle of the angled segment changes as the coil is enlarged or reduced by rotation of the mandrel;

a surface inspection system comprising at least one sensor operable to detect a characteristic of a surface of the strip of metal, the surface defined in the angled segment or in the coil; and a robotic assembly movable to modify an orientation of the at least one sensor of the surface inspection system relative to the surface;

wherein the strip of metal comprises a top face facing upward and a bottom face facing downward, wherein the robotic assembly facilitates detection by the at least one sensor of the top face and the bottom face, wherein the at least one sensor comprises multiple sensors, wherein the robotic assembly facilitates simultaneous detection of the top face and the bottom face by the multiple sensors, wherein the multiple sensors comprise a first sensor for detecting the angled segment and a second sensor for detecting the coil, and wherein the robotic assembly comprises a robotic manipulator supporting the first sensor and the second sensor.

2. The system of claim 1, wherein the robotic assembly facilitates sequential detection of the top face and the bottom face and is movable to arrange the surface inspection system in a first setting for detecting the top face and movable to arrange the surface inspection system in a second setting for detecting the bottom face.

3. The system of claim 2, wherein in the first setting the at least one sensor is detecting one of the angled segment or the coil and in the second setting the at least one sensor is detecting the other of the angled segment or the coil.

4. The system of claim 3, wherein in the first setting the at least one sensor is one of above or below the angled segment and in the second setting the at least one sensor is the other of above or below the angled segment.

5. The system of claim 1, wherein the multiple sensors comprise an upper sensor positionable by the robotic assembly above the angled segment and a lower sensor positionable by the robotic assembly below the angled segment.

6. The system of claim 5, wherein the robotic assembly comprises:

a first robotic manipulator supporting the upper sensor; and a second robotic manipulator supporting the lower sensor.

7. The system of claim 5, further comprising a bracket supported by the robotic assembly and comprising:

an upper member supporting the upper sensor;

a lower member supporting the lower sensor; and a slot defined between the upper member and the lower member and sized for passage of the angled segment therethrough.

8. The system of claim 1, wherein the surface is defined in the angled segment.

9. The system of claim 1, wherein the surface is defined in the coil.

10. A method comprising:

redirecting a strip of metal about a roller so as to define an angled segment of the strip of metal, the angled segment extending away from the roller and arranged at an angle relative to the roller;

rotating a mandrel to change a size of a coil connected with the angled segment of the strip of metal such that a magnitude of the angle of the angled segment changes as the coil is enlarged or reduced by the rotating of the mandrel;

detecting a characteristic of a surface of the strip of metal via at least one sensor of a surface inspection system, the surface defined in the angled segment or in the coil; and robotically moving the at least one sensor to modify an orientation of the at least one sensor of the surface inspection system relative to the surface;

wherein the strip of metal comprises a top face facing upward and a bottom face facing downward, wherein the robotically moving is performed by a robotic assembly that facilitates detection by the at least one sensor of the top face and the bottom face, wherein the at least one sensor comprises multiple sensors, wherein the robotic assembly facilitates simultaneous detection of the top face and the bottom face by the multiple sensors, wherein the multiple sensors comprise a first sensor for detecting the angled segment and a second sensor for detecting the coil, and wherein the robotic assembly comprises a robotic manipulator supporting the first sensor and the second sensor.

11. The method of claim 10, wherein the detecting a characteristic comprises:

detecting relative to a first subset of a width of the strip of metal during a first part of a production process; and detecting relative to a second subset of the width of the strip of metal during a second part of the production process.

12. The method of claim 10, wherein the detecting a characteristic comprises:

detecting relative to the top face during a first part of a production process that involves a first coil; and detecting relative to the bottom face during a second part of the production process that involves a second coil.

13. A robotic assembly comprising:

a surface inspection unit;

a robotic manipulator coupleable with the surface inspection unit to manipulate an angular orientation of the surface inspection unit; and a controller operatively coupleable with the robotic manipulator to cause the robotic manipulator to alter the angular orientation of the surface inspection unit relative to at least one of an angled segment of a metal strip subject to a change in angle during processing or a coil subject to a change in size during rotation of the coil about a mandrel;

wherein the metal strip comprises a top face facing upward and a bottom face facing downward, wherein the surface inspection unit comprises at least one sensor operable to detect a characteristic of a surface of the strip of metal, the surface defined in the angled segment or in the coil;

wherein the robotic assembly facilitates detection by the at least one sensor of the top face and the bottom face, wherein the at least one sensor comprises multiple sensors, wherein the robotic assembly facilitates simultaneous detection of the top face and the bottom face by the multiple sensors, wherein the multiple sensors comprise a first sensor for detecting the angled segment and a second sensor for detecting the coil, and wherein the robotic assembly comprises a robotic manipulator supporting the first sensor and the second sensor.

14. The robotic assembly of claim 13, wherein the surface inspection unit comprises at least one sensor that comprises at least one of:

a thermal camera, a pyrometer, or another thermal sensor;

a roughness sensor; or an optical sensor.

15. The robotic assembly of claim 13, wherein the surface inspection unit comprises:

at least one sensor configured for providing information about a surface characteristic of the angled segment or the coil; and at least one sensor configured for providing information about an orientation and a distance of the surface inspection unit relative to the angled segment or the coil.

16. The robotic assembly of claim 13, wherein the controller is configured to control the robotic manipulator at least in part in response to information about an arrangement of the angled segment or the coil, the information about the arrangement being derived from information about rotation of a mandrel that changes at least one of the size of the coil or the orientation of the angled segment.

* * * * *